US005950816A

United States Patent [19]

Reid

[11] Patent Number: 5,950,816

[45] Date of Patent: Sep. 14, 1999

[54] PERSONAL CARRIER CASE

[76] Inventor: Stanley Reid, 3775 NW. 171st Terrace, Miami, Fla. 33055

[21] Appl. No.: 08/989,191

[22] Filed: Dec. 11, 1997

[51] Int. Cl.[6] ..... B65D 50/12

[52] U.S. Cl. ..... 206/38.1; 206/457

[58] Field of Search ..... 206/457, 38, 38.1, 206/234, 37, 37.1, 1.5; 220/351

[56] References Cited

U.S. PATENT DOCUMENTS

| | | | |
|---|---|---|---|
| 1,498,640 | 6/1924 | Raynolds | 220/351 |
| 1,963,552 | 6/1934 | Horwitt | 206/457 X |
| 2,751,913 | 6/1956 | Wilk | 206/457 X |
| 2,854,132 | 9/1958 | Bjerknes et al. | 206/37 |
| 2,955,704 | 10/1960 | Carrington | 206/38 |
| 3,069,890 | 12/1962 | McKinney et al. | 70/456 |
| 3,092,244 | 6/1963 | McWhirter | 206/38 |
| 3,302,678 | 2/1967 | Leguillon | 150/40 |
| 3,816,057 | 6/1974 | Semenko | 206/457 X |
| 4,132,312 | 1/1979 | Kamada | 206/457 X |
| 4,573,332 | 3/1986 | Ma | 70/30 |
| 4,917,254 | 4/1990 | Ciriacks | 220/351 |
| 5,074,417 | 12/1991 | Kenny | 206/457 X |
| 5,082,137 | 1/1992 | Weinstein | 220/351 X |
| 5,188,227 | 2/1993 | Ho | 206/457 X |

*Primary Examiner*—Jacob K. Ackun

*Attorney, Agent, or Firm*—Frank L. Kubler

[57] ABSTRACT

A security box for retaining personal items includes a tray portion having a tray rear wall and a tray side wall, a cover portion having a front wall for removably engaging and closing the tray portion, a mechanism for removably interconnecting the tray portion and the cover portion, and camouflage elements making the security box appear to be an item other than a security box. The camouflage elements preferably include at least one protrusion having the general appearance of a button for a conventional alarm control unit protruding from an exterior face of the security box. The security box is preferably made of gray or black plastic. The security box preferably additionally includes thumb gripping ridges on the outer face of the cover front wall for increased gripping friction during opening and closing of the security box. A security box for retaining personal items includes an enclosure having an enclosure wall defining an item receiving chamber within the enclosure, a structure for opening and closing the enclosure to insert and remove a personal item, and camouflage elements making the enclosure appear to be an alarm control unit. A security box for retaining personal items alternatively includes an enclosure having an enclosure wall defining a personal item receiving chamber within the enclosure, a structure for opening and closing the enclosure to insert and remove personal items, and camouflage elements making the enclosure appear to be a pager unit.

14 Claims, 2 Drawing Sheets

PERSONAL CARRIER CASE

This application is based on the contents of Disclosure Document Number 426285 recorded on Oct. 16, 1997.

BACKGROUND OF THE INVENTION

1. Field of the Invention

The present invention relates generally to the field of containers for retaining personal items which can be worn or otherwise carried by the owner. More specifically the present invention relates to a personal item container in the form of a security box which is sized, shaped and styled to closely resemble a alarm control unit of the type normally mounted on automobile key rings, so that certain personal items can be hidden from acquaintances and from would-be thieves. Such personal items might include jewelry, money, a one day supply of medicine, contraceptives or miscellaneous other objects such as safety deposit box keys.

The security box preferably includes a tray portion having a rectangular tray rear wall and tray side walls, and a cover portion with a rectangular front wall of the same dimensions as the tray rear wall, which removably engages and closes the tray portion. Nonfunctional rectangular buttons protrude from the exterior face of either the tray rear wall or the cover front wall to simulate those provided on a car alarm control unit.

A key ring tab preferably protrudes upwardly from the upper tray side wall outer face. The key ring tab includes a tab port through which a user key ring or chain may be fitted.

2. Description of the Prior Art

There have long been various containers for retaining, and in some instances concealing, keys and other small personal items. Common examples include lockets and wallets.

McKinney, et al., U.S. Pat. No. 3,069,890, issued on Dec. 25, 1962, discloses a magnetic key holder for hiding ignition and trunk keys. McKinney, et al. includes a nonmagnetic U-shaped body structure having a magnet secured to the outer face of a first leg portion and an ornamental or vehicle identification plate secured to the outer face of a second leg portion. A screw fitted with a tubular nut extends through opposing bores in the leg portion free ends and vehicle keys are pivotally fitted around the tubular nut. A problem with McKinney, et al. is that it is useful for concealing keys only by securing the holder to some metallic surface, and is useless for concealing items carried on the person of the user. A magnetic key concealment means generally similar to that of McKinney, et al., is provided in Leguillon, U.S. Pat. No. 3,302,678, issued on Feb. 7, 1967. Leguillon includes a flexible plastic envelope having a central space which opens through at least one envelope end for receiving a vehicle key. One of the flat sides of the envelope is provided with loop straps under which magnetic members are removably placed. The flexibility of the plastic permits distortion of the envelope for placement on curved and irregular vehicle surfaces for enhanced concealment. The problems of McKinney, et al. are again presented.

McWhirter, U.S. Pat. No. 3,092,244, issued on Jun. 4, 1963, teaches a pocket key assembly for use by military personnel. McWhirter includes a flat, rectangular metal case having a pocket clip and containing a key holding compartment. The key holding compartment is accessible by opening a hinged case end wall. The case also contains a special pencil retaining passageway, from which the pencil point protrudes so that the user can write while the pencil is inside the case. The broad outer case surfaces are reflective so that the case can additionally function as a mirror. A problem with McWhirter is that the case is conspicuous and unusual in appearance, and looks like a case in which something might be contained.

Bjerknes, et al., U.S. Pat. No. 2,854,132, issued on Sep. 30, 1958, reveals a key case carried on a wrist band. Bjerknes, et al., includes a flat, elongated container and means for connecting a wristband to the container. A drawer is provided to receive a key and is mounted slidably within the container. Releasable locking means retain the drawer in a retracted, closed position, and spring means operate to automatically move the drawer into an extended, open position when the locking means are released. The problems of McWhirter are again presented.

Ma, U.S. Pat. No. 4,573,332, issued on Mar. 4, 1986, discloses a portable security box. Ma includes a container formed from a pair of opposing trays hingedly interconnected at one tray end. One of the trays carries a lock. The lock releasibly holds the trays together to prevent unauthorized access to items enclosed by the opposing trays. A first end of a flexible cable extends from the lock for wrapping around any structure suitable for anchoring the container against theft, and for additionally extending through larger personal items to be protected. The second end of the cable is releasibly engaged by the lock. A problem with Ma is that, as illustrated, it is too large to carry inconspicuously. Another problem is that Ma, like McWhirter, is unmistakably a security box, making it an obvious target for theft and otherwise drawing attention where attention is not desired.

Carrington, U.S. Pat. No. 2,955,704, issued on Oct. 11, 1960, teaches a concealed key and utility case. Carrington includes a utility case having the appearance of a cigarette case and internal space for actually retaining cigarettes. The case includes key-engaging pivotal linkages which are extendable outwardly from the case for key access and use, and which are retractable into the sides of the case for key storage and concealment. A problem with Carrington is that the only type of personal item fully suitable for concealment in the case in the manner intended is keys. Another problem is that Carrington is relatively complex and would be relatively expensive to manufacture.

It is thus an object of the present invention to provide a security box for containing and concealing from view private or valuable items.

It is another object of the present invention to provide such a security box which is inconspicuous when carried by the user.

It is still another object of the present invention to provide such a security box which is camouflaged to closely resemble some other item frequently carried by people, and preferably to closely resemble an alarm control unit.

It is finally an object of the present invention to provide such a security box which is compact, easy to carry such as on a key ring and is economical to manufacture.

SUMMARY OF THE INVENTION

The present invention accomplishes the above-stated objectives, as well as others, as may be determined by a fair reading and interpretation of the entire specification.

A security box is provided for retaining personal items, including a tray portion having a tray rear wall and a tray side wall, a cover portion having a front wall for removably engaging and closing the tray portion, a mechanism for removably interconnecting the tray portion and the cover portion, and camouflage elements making the security box appear to be an item other than a security box.

The camouflage elements preferably include at least one protrusion having the general appearance of a button for a conventional alarm control unit protruding from an exterior face of the security box. The security box is preferably made of gray or black plastic.

The tray rear wall is preferably rectangular and has rear wall edges and the tray side wall preferably includes two longitudinal tray side walls and upper and lower lateral tray side walls, the longitudinal and lateral tray side walls extending along the rear wall edges and intersecting each other to form tray corners, the two longitudinal tray side walls protruding forwardly beyond the lower lateral tray side wall, each longitudinal tray side wall having a longitudinal tray groove recessed into its outer face defining a tray bead along the longitudinal tray side walls, and the cover front wall is preferably rectangular and has front wall edges and the cover portion preferably includes longitudinal cover side walls extending along the front wall edges, and a cover bead protrudes inwardly along each cover side wall and is sized and positioned to slide longitudinally and engagingly into a corresponding the tray groove, so that sliding the cover portion beads into the tray grooves removably connects the cover portion to the tray portion.

The security box preferably additionally includes a cover portion slide stop structure. The stop structure preferably includes a tab protruding inwardly from the upper end of the interior face of the front wall for abutting the interior face of the lower tray side wall to stop sliding of the cover portion relative to the tray portion.

The cover portion preferably includes a snap latch structure including at least one inwardly protruding dimple at the lower end of the front wall for sliding over the forward end of the lower tray side wall with sliding resistance. The upper tray side wall preferably extends forwardly beyond the longitudinal tray side walls, so that the cover portion abuts and stops against the upper tray side wall at a point at which the cover portion substantially covers the tray portion. The security box preferably additionally includes thumb gripping ridges on the outer face of the cover front wall for increased gripping friction during opening and closing of the security box. A set of the thumb gripping ridges is preferably located at the upper end of the front wall and a set of the thumb gripping ridges is also preferably located at the lower end of the front wall and each of these sets preferably includes a series of concentric, semicircular protrusions. The security box preferably still further includes a key ring tab protruding upwardly from the outer face of the upper tray side wall and having a tab port for receiving a user key ring. The at least one protrusion preferably extends from the cover front wall, or alternatively extends from the tray rear wall.

A security box is further provided for retaining personal items, including an enclosure having an enclosure wall defining an item receiving chamber within the enclosure, a structure for opening and closing the enclosure to insert and remove a personal item, and camouflage elements making the enclosure appear to be an alarm control unit.

A security box is still further provided for retaining personal items, including an enclosure having an enclosure wall defining a personal item receiving chamber within the enclosure, a structure for opening and closing the enclosure to insert and remove personal items, and camouflage elements making the enclosure appear to be a pager unit.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
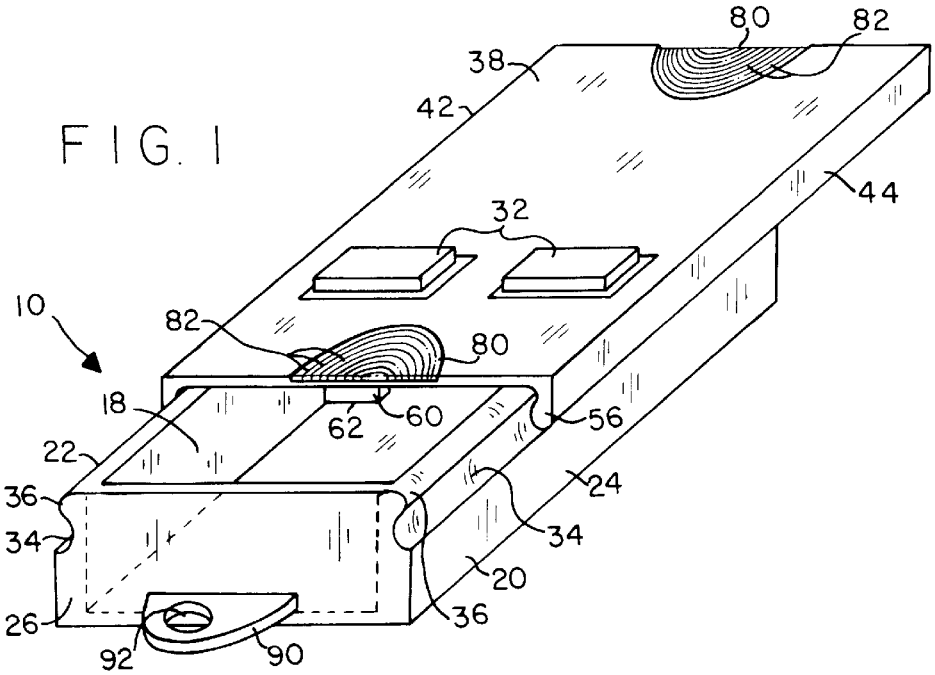
FIG. 1 is a perspective bottom view of the first preferred embodiment of the security box having the appearance of an alarm control unit, with the cover portion partially slid off the tray portion so that the box is partly open. The interconnecting tray grooves and cover beads are illustrated.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
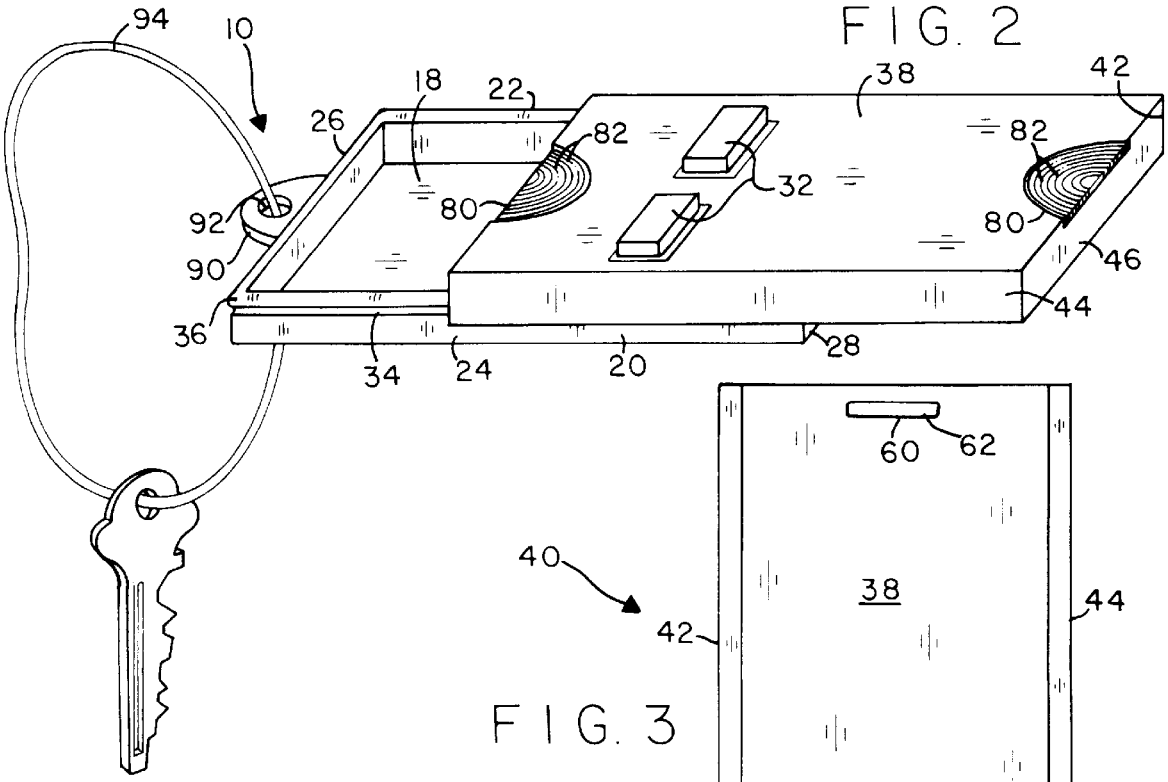
FIG. 2 is a perspective side view of the security box, showing the camouflaging buttons and thumb gripping ridges.
Figure 3:
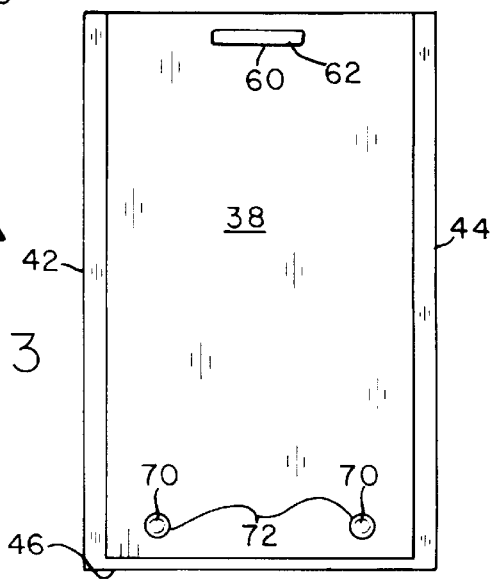
FIG. 3 is a rear view of the preferred cover portion, revealing the protruding dimples of the cover snap latch means at the lower end, and the stop means tab at the upper end, of the cover front wall interior face.

Referring to FIGS. 1–3, a security box 10 is disclosed which is sized, shaped and styled to closely resemble an automobile or house alarm control unit, for concealing personal items from the view of acquaintances as well as from would-be thieves.

Security box 10 preferably includes a tray portion 20 having a rectangular tray rear wall 18 and tray side walls 22–28, and a cover portion 40 having a rectangular front wall 38 sized and shaped to match rear wall 18 and which removably engages and closes tray portion 20. Nonfunctional buttons 32, which are preferably rectangular, are provided to simulate those commonly found on an alarm control units. Buttons 32 are preferably integral with and protrude from the exterior face of either the tray rear wall 18 or the cover front wall 38, but preferably from cover front wall 38. Security box 10 is preferably made of dark gray or black plastic, or any of numerous other colors or of transparent plastic, closely resembling the plastic from which most alarm control units are made. Buttons 32 are optionally painted or otherwise pigmented to contrast in color with the rest of security box 10.

Tray portion 20 preferably includes two longitudinal tray side walls 22 and 24 and upper and lower lateral tray side walls 26 and 28, respectively. The longitudinal and lateral tray side walls 22–28 are integral with and extend along edges of tray rear wall 18 and intersect each other to form tray portion 20 corners. Longitudinal tray side walls 22 and 24 preferably protrude forwardly beyond lower lateral tray side wall 28, and each has a longitudinal tray groove 34 recessed into its outer face defining a longitudinal tray bead 36 along each side wall 22 and 24 forward end.

Cover portion 40 also preferably includes longitudinal cover side walls 42 and 44 integral with and extending along longitudinal edges of tray front wall 38, and bottom wall 46 integral with and extending along the bottom edge of tray front wall 38. A cover bead 56 protrudes inwardly along each longitudinal cover side wall 42 and 44 rearward end and is sized and positioned to slide longitudinally and engagingly into a corresponding tray groove 34. Sliding cover beads 56 into the ends of and along tray grooves 34 removably connects cover portion 40 to tray portion 20 so that any items placed within tray portion 20 are covered and retained, and security box 10 is thus completed. To open security box 10, cover portion 40 is slid longitudinally relative to tray portion 20 until the contents of tray portion 20 are sufficiently exposed for user access.

A preferred additional feature is cover portion 40 slide stop means 60. Stop means 60 preferably includes a tab 62 protruding inwardly from the upper end of the cover front wall 38 interior face which abuts the lower tray side wall 28 interior face to stop the outward sliding of cover portion 40 relative to tray portion 20. See FIG. 3. Cover portion 40 snap latch means 70 are preferably also provided in the form of two dimples 72 near the forward wall 38 lower end protruding inwardly to slide over the front end of lower tray side wall 28 with sliding resistance. As a result, cover portion 40 slides almost fully over tray portion 20, and then a slightly increased sliding force is required to drive dimples 72 over the lower tray side wall 28. The cover front wall 38 resiliently deflects outwardly as dimples 72 ride over lower tray side wall 28 and then returns to its original planar shape as a result of elastic memory of the cover portion 40 material. The upper tray side wall 26 preferably extends forwardly beyond longitudinal tray side walls 22 and 24 so that cover portion abuts and is stopped by the upper tray side wall 26 at the point where the cover portion 40 is fully over tray portion 20.

Thumb grip ridges 80 are preferably also provided in the cover portion front wall 38 outer face for increased gripping friction for ease of opening and closing security box 10. The thumb grip ridges 80 are preferably provided at the upper and lower ends of the front wall 38 outer face and each include a series of concentric, semicircular elongate protrusions 82.

A key ring tab 90 preferably protrudes upwardly from the upper tray side wall 26 outer face. Key ring tab 90 includes a tab port 92 through which a user key loop 94 such as a key ring or chain may be fitted.

Second Preferred Embodiment

Figure 4:
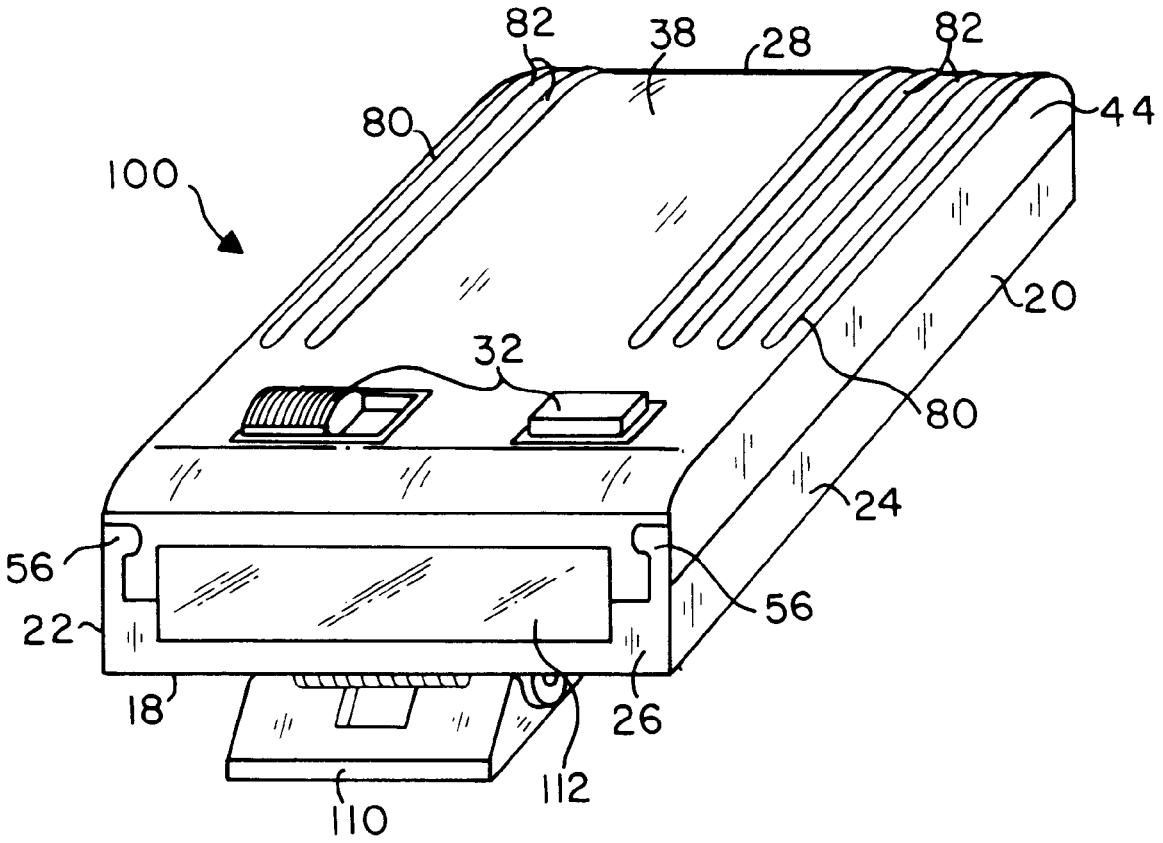
FIG. 4 is a perspective view of the pager unit embodiment of the security box, showing the alternative placement of the simulated buttons and the addition of the simulated pager window and the functional belt clip panel.

A second embodiment is provided which is like the first except that the placement and arrangement of buttons 32 and rectilinear thumb gripping ridges 80 are altered to give security box 100 the appearance of a pager unit. See FIG. 4. The key ring tab 90 is replaced by a pivoting, spring biased belt clip panel 110 of the type conventional on pager units. A transparent plastic window 112 is optionally provided in the upper end of security box 100 to further impart the appearance of a pager unit.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A box and key retaining loop apparatus for retaining personal items, comprising:

a tray portion sized to fit within a clothing pocket and having a tray rear wall and two opposing and spaced apart longitudinal tray side walls, an upper lateral tray side wall and a lower lateral tray side wall, each said wall having a wall exterior face, a cover portion having a front wall for removably engaging and closing said tray portion, said front wall having a wall exterior face, means for removably interconnecting said tray portion and said cover portion, and camouflage means comprising at least two protrusions extending from a wall exterior face of said box for providing the appearance of finger press buttons, a key ring tab protruding upwardly from the exterior face of said upper lateral tray side wall and having a tab port and a key retaining loop fitted through said tab port.

2. The apparatus of claim 1, wherein said key retaining loop is a key chain.

3. The apparatus of claim 1, wherein said key retaining loop is a key ring.

4. The apparatus of claim 1, wherein said security box is made of pigmented plastic.

5. The apparatus of claim 1, wherein said tray rear wall is rectangular and has rear wall edges, said longitudinal and lateral tray side walls extending along said rear wall edges and intersecting each other to form tray corners, said two longitudinal tray side walls protruding forwardly beyond said lower lateral tray side wall, each longitudinal tray side wall having a longitudinal tray groove recessed into its outer face defining a tray bead along said longitudinal tray side walls, and wherein said cover front wall is rectangular and has front wall edges and wherein said cover portion comprises longitudinal cover side walls extending along said front wall edges, and a cover bead protrudes inwardly along each cover side wall and is sized and positioned to slide longitudinally and engagingly into a corresponding said tray groove, such that sliding said cover portion beads into said tray grooves removably connects said cover portion to said tray portion.

6. The apparatus of claim 5, additionally comprising cover portion slide stop means.

7. The apparatus of claim 6, wherein said stop means comprises a tab protruding inwardly from the upper end of the interior face of said front wall for abutting the interior face of said lower tray side wall to stop sliding of said cover portion relative to said tray portion.

8. The apparatus of claim 5, additionally comprising cover portion snap latch means including at least one inwardly protruding dimple at the lower end of said front wall for sliding over the forward end of said lower tray side wall with sliding resistance.

9. The apparatus of claim 5, wherein said upper tray side wall extends forwardly beyond said longitudinal tray side walls, such that said cover portion abuts and stops against said upper tray side wall at a point at which said cover portion substantially covers said tray portion.

10. The apparatus of claim 5, additionally comprising thumb gripping ridges on the outer face of said cover front wall for increased gripping friction during opening and closing of said security box.

11. The apparatus of claim 10, wherein a set of said thumb gripping ridges is located at the upper end of said front wall and a set of said thumb gripping ridges is located at the lower end of said front wall and each said set comprises a series of concentric, semicircular protrusions.

12. The apparatus of claim 2, wherein said at least one protrusion extends from said cover front wall.

13. The apparatus of claim 2, wherein said at least one protrusion extends from said tray rear wall.

14. A box and key retaining loop apparatus for retaining personal items, comprising:

a tray portion having a tray rear wall and a tray side wall, each said wall having a wall exterior face, a cover portion having a cover front wall for removably engaging and closing said tray portion, said cover front wall having a wall exterior face, means for removably interconnecting said tray portion and said cover portion, and camouflage means comprising at least one protrusion extending from at least one said wall exterior face for providing the appearance of a finger press button, a key ring tab protruding upwardly from one said wall and having a tab port and a key retaining loop fitted through said tab port.

* * * * *